US005576272A

United States Patent [19]

Okawa et al.

[11] Patent Number: 5,576,272

[45] Date of Patent: Nov. 19, 1996

[54] GREASE COMPOSITION FOR CONSTRUCTION EQUIPMENTS

[75] Inventors: Satoshi Okawa, Kawasaki; Akimi Kimura; Hiroshi Kimura, both of Fujisawa, all of Japan

[73] Assignees: Komatsu Ltd.; Kyodo Yushi Co., Ltd., both of Tokyo, Japan

[21] Appl. No.: 616,476

[22] Filed: Mar. 19, 1996

[30] Foreign Application Priority Data

Aug. 4, 1995 [JP] Japan ..... 7-199349

[51] Int. Cl.[6] ..... C10M 125/28; C10M 125/24

[52] U.S. Cl. ..... 508/159; 508/161; 508/179

[58] Field of Search ..... 252/25, 18, 33.4, 252/46.6, 47

[56] References Cited

U.S. PATENT DOCUMENTS

| | | | |
|---|---|---|---|
| 2,926,138 | 2/1960 | Huet | 252/30 |
| 3,161,595 | 12/1964 | Fenker | 252/28 |
| 4,068,513 | 1/1978 | Guerit et al. | 252/25 |
| 4,172,032 | 10/1979 | Farley | 210/58 |
| 5,207,935 | 5/1993 | Waynick | 252/18 |

FOREIGN PATENT DOCUMENTS

| | | |
|---|---|---|
| 7-041781 | 2/1995 | Japan . |
| 7-082583 | 3/1995 | Japan . |

*Primary Examiner*—Margaret Medley
*Attorney, Agent, or Firm*—Oblon, Spivak, McClelland, Maier & Neustadt, P.C.

[57] ABSTRACT

A grease composition for construction equipment comprises a lubricating grease, a) 1 to 5% by weight of phosphate glass and b) 1 to 5% by weight of a sulfur-phosphorus extreme-pressure additive; as well as c) 0.5 to 3% by weight of an aromatic sulfonic acid salt and d) 0.1 to 3% by weight of a triazole compound as optional components based on the total weight of the grease composition. The grease composition exhibits considerably high resistance to load and accordingly, can be applied to construction equipment which require high resistance to load, such as a hydrauric excavator and a wheel loader.

10 Claims, No Drawings

GREASE COMPOSITION FOR CONSTRUCTION EQUIPMENTS

BACKGROUND OF THE INVENTION

The present invention relates to a grease composition for construction equipment.

A grease to which a black solid lubricant such as molybdenum disulfide or graphite is added has conventionally been applied to parts of construction equipment to be lubricated because of the excellent lubricity thereof. However, such a grease suffers from various problems in that, when the grease is used as a lubricating grease for construction equipment which have recently been provided with beautiful multi-color coating, the grease considerably impairs the appearance of the equipment and the body and/or clothes of operators of the equipment are contaminated with the grease since the grease is black in appearance. To solve these problems, many attempts have been done, which make use of extreme-pressure agents having a color other than black such as organic molybdenum compounds, polytetrafluoroethylene ( PTFE ), an adduct of melamine with cyanuric acid (MCA), or the like. The use of a lubricant having a color other than black permits the solution of the problem concerning the appearance of construction equipment and pollution of the working environment, but there has never been developed any grease composition exhibiting the lubricity comparable to that of the molybdenum disulfide-containing grease conventionally used. In addition, Japanese Un-Examined Patent Publication (hereinafter referred to as "J. P. KOKAI") No. Hei 7-82583 discloses a grease composition which makes use of synthetic mica as a lubricity-improving agent, but the composition exhibits poor lubricity and would not have quality sufficient for use as the grease composition for construction equipment.

Moreover, J. P. KOKAI No. Hei 7-41781 discloses a lubricant composition comprising phosphate glass. The lubricant composition is excellent in resistant to load as compared with the conventional lubricant compositions. However, the lubricant composition is still insufficient in the resistant to load when it is applied to construction equipment which require extremely high resistance to load.

SUMMARY OF THE INVENTION

Accordingly, it is an object of the present invention to provide a grease composition for construction equipment free of the foregoing problems, in particular, to provide a grease composition for construction equipment which is free of black solid lubricants such as molybdenum disulfide and graphite for the purpose of improving the working environment, which exhibits lubricity comparable to those comprising the black solid lubricants and which can reduce or prevent the occurrence of any squeak, sintering or the like at the pin-bush portions of construction equipment such as hydrauric excavators and wheel loaders.

The inventors of this invention have conducted various studies of combinations of phosphate glass with a variety of additives to solve the foregoing problems associated with the conventional techniques and to develop a lubricant composition for construction equipment which require quite high resistance to load, have found out that a grease composition for construction equipment which exhibits particularly excellent lubricity when applied to construction equipment can be obtained by the simultaneous use of, for instance, a sulfur-phosphorus extreme-pressure additive and thus have completed the present invention.

According to the present invention, there is provided a grease composition for construction equipment which comprises a lubricating grease, a) 1 to 5% by weight of phosphate glass and b) 1 to 5% by weight of a sulfur-phosphorus type extreme-pressure additive based on the total weight of the grease composition.

In a preferred embodiment of the present invention, the grease composition further comprises c) 0.5 to 3% by weight of an aromatic sulfonic acid salt in addition to the components a) and b).

In another preferred embodiment of the present invention, the grease composition further comprises d) 0.1 to 3% by weight of a triazole compound in addition to the components a) and b).

In a still another preferred embodiment of the present invention, the grease composition further comprises c) 0.5 to 3% by weight of an aromatic sulfonic acid salt and d) 0.1 to 3% by weight of a triazole compound in addition to the components a) and b).

DESCRIPTION OF THE PREFERRED EMBODIMENTS

The grease composition for construction equipment will hereinafter be described in more detail.

The grease composition for construction equipment of the present invention comprises a lubricating grease, a) 1 to 5% by weight of phosphate glass and b) 1 to 5% by weight of a sulfur-phosphorus type extreme-pressure additive as well as c) 0.5 to 3% by weight of an aromatic sulfonic acid salt and/or d) 0.1 to 3% by weight of a triazole compound as optional components based on the total weight of the grease composition.

The lubricating grease composition used in the invention comprises a base oil and a thickener. The base oil usable herein is not restricted to specific ones and may be, for instance, animal oils, vegetable oils, mineral oils and synthetic lubricating oils.

The thickeners usable in the present invention is not likewise limited to particular ones and may be those commonly used in the usual grease compositions. Examples thereof are metal soaps, ureas, organic derivatives of bentonite and silica. Specific examples thereof are metal salts such as lithium 12-hydroxystearate, calcium hydroxystearate and lithium complex; ureas such as aliphatic diureas, alicyclic diureas and aromatic diureas; organic derivatives of bentonite such as montmorillonite treated with quaternary ammonium salts; and silica such as super fine particulate silica powder prepared by a vapor phase reaction and such silica powder whose surface is treated with a lower alcohol such as methanol.

The phoshpate glass used in the invention as the component a) may be the one which is well-known as one of oxide glasses, and is composed basically of $PO_4$ tetrahedrons.

The phosphate glass used in the invention as the component a) preferably comprises 45 to 75 mole % of $P_2O_5$, 10 to 35 mole % of $M_2O$ (wherein M represents an alkali metal) and 0 to 45 mole % of $B_2O_3$. The phosphate glass may optionally comprise, for instance, $Al_2O_3$, $Ti_2O_2$, MgO and $SiO_2$ in addition to the foregoing essential components. The phosphate glass may be commercially available and is sold under the trade name of M-1, L-5, SM-5, M-3 and M-10 (all of them are available from Taihei Kagaku Sangyo Co., Ltd.). More specifically, M-1 comprises 63 mole % of $P_2O_5$, 16 mole % of $Na_2O$, 19 mole % of $K_2O$ and 2 mole % of $B_2O_3$;

L-5 comprises 48 mole % of $P_2O_5$, 10 mole % of $Na_2O$, 15 mole % of $K_2O$ and 7 mole % of $Ti_2O_2$; M-3 comprises 60 mole % of $P_2O_5$, 19 mole % of $Na_2O$ and 21 mole % of $K_2O$; M-10 comprises 57 mole % of $P_2O_5$, 14 mole % of $Na_2O$, 17 mole % of $K_2O$ and 2 mole % of $B_2O_3$; and SM-5 mainly comprises, for instance, P, Al, Na and F.

The phosphate glass used in the invention as the component a) may be prepared by the method commonly used in this field. For instance, the phosphate glass may be prepared by mixing (i) at least one compound selected from the group consisting of phosphoric acid and salts thereof, (ii) at least one compound selected from the group consisting of carbonates, nitrates, sulfates and hydroxides of alkali metals and (iii) at least one compound selected from the group consisting of boric acid and salts thereof so that the resulting mixture of the compound (i) (ii) and (iii) comprises, as expressed in terms of oxides, 45 to 75 mole % of $P_3O_5$, 10 to 35 mole % of $M_2O$ (wherein M represents an alkali metal) and 0 to 45 mole % of $B_2O_3$, then melting the mixture at a temperature ranging generally from 400° C. to 700° C. and cooling the molten mixture.

The foregoing raw materials for the phosphate glass may be those commonly used in this art.

Specific examples of the compounds (i) are phosphoric acid and phosphoric acid salts such as sodium primary phosphate, potassium primary phosphate, sodium metaphosphate, sodium secondary phosphate, potassium secondary phosphate, condensed sodium phosphate and condensed potassium phosphate.

Specific examples of the compounds (ii) are sodium carbonate, potassium carbonate, sodium nitrate, potassium nitrate, sodium sulfate, potassium sulfate, sodium hydroxide and potassium hydroxide.

Specific examples of the compounds (iii) include boric acid and boric acid salts such as sodium borate and potassium borate.

These compounds each may be used in the preparation of the phosphate glass in the form of powder, an aqueous solution or an aqueous suspension.

The amount of the component a) ranges from 1 to 5% by weight and preferably 1 to 3% by weight. This is because if it exceeds 5% by weight, any further improvement in the effect cannot be expected and the use thereof in such an amount is unfavorable in view of profits. On the other hand, if it is less than 1% by weight, the lubricating properties of the resulting composition is not sufficiently improved.

The sulfur-phosphorus extreme-pressure agent used in the present invention as the component b) is a compound including both sulfur and phosphorus atoms in the molecule and specific examples thereof include Lubrizol 810 commercially available from LUBRIZOL JAPAN LIMITED.

The amount of the component b) ranges from 1 to 5% by weight and preferably 1 to 3% by weight. This is because if it exceeds 5% by weight, any further improvement in the effect cannot be expected and the use thereof in such an amount is unfavorable in view of profits. On the other hand, if it is less than 1% by weight, desired extreme-pressure properties cannot be imparted to the resulting grease composition.

Examples of the aromatic sulfonic acid salts used in the present invention as the component c) are metal salts of, for instance, benzenesulfonic acid and naphthalenesulfonic acid such as alkali metal salts and alkaline earth metal salts thereof (e.g., lithium dinonylnaphthalenesulfonate). These compounds are rust inhibitors and may be commercially available from KING INDUSTRY Company under the trade name of, for instance, NA-SUL 707 and NA-SUL CA 50.

The amount of the component c) suitably ranges from 0.5 to 3% by weight and preferably 1 to 3% by weight. This is because if it exceeds 3% by weight, any further improvement in the effect cannot be expected and the use thereof in such an amount is unfavorable in view of profits. On the other hand, if it is less than 0.5% by weight, the resulting grease composition is insufficient in the rust preventive property.

The triazole compound used in the present invention as the component d) may be, for instance, benzotriazole. This compound is a corrosion inhibitor for copper and may be commercially available. Specific examples thereof include BT-120 available from Jyohoku Chemical Industry Co., Ltd.; BT available from Kawaguchi Chemical Industry Co., Ltd.; and Reomet 39 available from CIBA-GEIGY Company.

The amount of the component d) suitably ranges from 0.1 to 3% by weight and preferably 1 to 3% by weight. This is because if it exceeds 3% by weight, any further improvement in the effect cannot be expected and the use thereof in such an amount is unfavorable in view of profits. On the other hand, if it is used in an amount of less than 0.1% by weight, the resulting grease composition is insufficient in the anti-corrosive property.

The grease composition of the present invention may further comprise, in addition to the foregoing essential components, various kinds of additives currently used in this field. Examples of such additives include extreme-pressure additives other than the foregoing component b), antioxidants, oiliness agents, viscosity index improvers, pour point depressants and adhesive strength improvers. The amounts of these additives to be incorporated into the composition each may fall within the range currently used in this art.

Examples of the extreme-pressure additives other than the component b) include zinc dithiophosphate and zinc dialkyl dithiocarbamate; examples of the antioxidants are 2,6-di-tert-butyl-p-cresol and dioctyldiphenylamine; examples of the oiliness agents are castor oil; examples of the viscosity index improvers are polyisobutylene and ethylene/α-olefin copolymers (OCP); and examples of the pour point depressants and adhesive strength improvers are polymethacrylate.

The grease composition of the present invention comprises a) 1 to 5% by weight of phosphate glass and b) 1 to 5% by weight of a sulfur-phosphorus extreme-pressure additive as well as c) 0.5 to 3% by weight of an aromatic sulfonic acid salt and/or d) 0.1 to 3% by weight of a triazole compound as optional components and therefore, the composition is substantially improved in the ability of withstanding a high load. Accordingly, the grease composition of the present invention can effectively be used as a lubricating composition for construction equipment such as a hydrauric excavator and a wheel loader which require very high resistance to load.

The present invention will hereinafter be described in more detail with reference to the following non-limitative working Examples and the effects practically accomplished by the present invention will also be discussed in detail in comparison with Comparative Examples.

EXAMPLE 1

Preparation of Lithium Complex Greases

Various grease compositions were prepared by incorporating a variety of additives listed in the following Table 1 into a grease which comprised a paraffinic mineral oil (kinematic viscosity of base oil, 40° C./100° C.: 160/16.8 $mm^2$/sec) as a base oil and a lithium soap mainly comprising lithium 12-hydroxystearate and a lithium complex soap consisting of lithium azelate as thickeners.

EXAMPLE 2 AND COMPARATIVE EXAMPLES 1 TO 8

Preparation of Lithium Soap Greases

Various grease compositions were prepared by incorporating a variety of additives listed in the following Table 1 into a grease which comprised a paraffinic mineral oil (kinematic viscosity of base oil, 40° C./100° C.: 160/16.8 $mm^2$/sec) as a base oil and a lithium soap mainly comprising lithium 12-hydroxystearate as a thickener.

In the foregoing Examples and Comparative Examples, solid lubricants used were phosphate glass (M-1 available from Taihei Kagaku Sangyo Co., Ltd.) (Examples 1 and 2); molybdenum disulfide (Comparative Example 1); graphite (Comparative Example 2); and an organic molybdenum compound (Comparative Example 4). In Comparative Example 3, the use of solid lubricant was omitted. In Comparative Example 5, the amount of the phosphate glass as the solid lubricant present in the additive formulation used in Example 2 was reduced to 0.5% by weight. On the other hand, in Comparative Example 6, the amount of the sulfur-phosphorus extreme-pressure agent present in the additive formulation used in Example 2 was reduced to 0.5% by weight. In Comparative Example 7, the additive formulation of Example 1 which was free of any rust inhibitor was used, while in Comparative Example 8, the additive formulation of Example 1 which was free of any corrosion inhibitor was used. In these Examples and Comparative Examples, lithium dinonylnaphthalenesulfonate and benzotriazole were used as the rust inhibitor and the corrosion inhibitor, respectively. The resulting grease compositions were inspected for the appearance and subjected to three kinds of tests for examining the extreme-pressure properties thereof. The results thus obtained are also listed in the following Table 1.

TABLE 1

Composition (% by weight) and Test Results

| Sample No. | Ex. 1 | Ex. 2 | Comp. Ex. 1 | Comp. Ex. 2 | Comp. Ex. 3 |
|---|---|---|---|---|---|
| thickener | | | | | |
| lithium complex | 12.00 | — | — | — | — |
| lithium 12-hydroxy-stearate | — | 9.0 | 9.0 | 9.0 | 9.0 |
| base oil (mineral oil) | 81.50 | 84.50 | 83.50 | 78.50 | 86.50 |
| a) solid lubricant | | | | | |
| phosphate glass | 2.5 | 2.5 | — | — | — |
| molybdenum disulfide | — | — | 3.0 | — | — |
| graphite | — | — | — | 8.0 | — |
| organic molybdenum | — | — | — | — | — |
| b) extreme-pressure agent | | | | | |
| sulfur-phosphorus | 2.5 | 2.5 | 1.0 | 1.0 | 1.0 |
| zinc dithiophosphate | — | — | 2.0 | 2.0 | 2.0 |
| c) rust inhibitor | 1.0 | 1.0 | 1.0 | 1.0 | 1.0 |
| d) corrosion inhibitor | 0.5 | 0.5 | 0.5 | 0.5 | 0.5 |
| Appearance | pale brown | pale brown | black | black | black |
| Four-ball EP test i) N Load Wear Index | 902 | 883 | 412 | 431 | 392 |
| Four-ball EP test ii) N Load Wear Index | 667 | 637 | 304 | 275 | incapable of calculation |
| Extreme-pressure test iii) Number required till causing the squeak | 3410 | 3300 | 2290 | 3250 | 1400 |
| Test for corrosion-preventive properties | #1 | #1 | #1 | #1 | #1 |
| Copper strip-corrosion test | None | None | None | None | None |

TABLE 1-continued

Composition (% by weight) and Test Results

| Sample No. | Comp. Ex. 4 | Comp. Ex. 5 | Comp. Ex. 6 | Comp. Ex. 7 | Comp. Ex. 8 |
|---|---|---|---|---|---|
| thickener | | | | | |
| lithium complex | — | — | — | 12.00 | 12.00 |
| lithium 12-hydroxy-stearate | 9.0 | 9.0 | 9.0 | — | — |
| base oil (mineral oil) | 81.50 | 86.50 | 86.50 | 82.50 | 82.00 |
| a) solid lubricant | | | | | |
| phosphate glass | — | 0.5 | 2.5 | 2.5 | 2.5 |
| molybdenum disulfide | — | — | — | — | — |
| graphite | — | — | — | — | — |
| organic molybdenum | 5.0 | — | — | — | — |
| b) extreme-pressure agent | | | | | |
| sulfur-phosphorus | 1.0 | 2.5 | 0.5 | 2.5 | 2.5 |
| zinc dithiophosphate | 2.0 | — | — | — | — |
| c) rust inhibitor | 1.0 | 1.0 | 1.0 | — | 1.0 |
| d) corrosion inhibitor | 0.5 | 0.5 | 0.5 | 0.5 | — |
| Appearance | yellow | pale brown | pale brown | pale brown | pale brown |
| Four-ball EP test i) N Load Wear Index | 520 | 490 | 814 | 892 | 863 |
| Four-ball EP test ii) N Load Wear Index | incapable of calculation | 216 | 422 | 618 | 588 |
| Extreme-pressure test iii) Number required till causing the squeak | 1750 | — | — | — | — |
| Test for corrosion-preventive properties | #1 | #1 | #1 | #3 | #1 |
| Copper strip-corrosion test | None | None | None | None | observed |

The foregoing test results will be discussed below in more detail.

Appearance

Each sample grease composition was visually inspected for the appearance.

The grease compositions of Examples 1 and 2 and Comparative Examples 3 to 8 had colors other than black, while the compositions of Comparative Examples 1 and 2 were colored black.

Tests for Extreme-Pressure Properties

The compositions each was inspected for the effect of preventing the scuffing, wearing and squeak of lubricated parts of construction equipment (the pin-bush portion for securing the bucket and for other work equipments of a hydrauric excavator and pin-bush portions of a wheel loader).

i) Evaluation of the grease compositions by the Four-ball EP Test (ASTM D2596): The comparison between the compositions were carried out on the basis of the abrasion indice under load.

The compositions of Examples 1 and 2 and Comparative Examples 6 to 8 showed high load wear index. Thus, they would have high extreme-pressure properties.

The compositions of Comparative Examples 1 to 5 showed low load wear index. Therefore, they would have low extreme-pressure properties.

ii) Evaluation of the grease compositions contaminated with dust by the Four-ball EP Test: In this test, the wear of the pin for securing the bucket due to the contamination with earth and sand was evaluated by carrying out the comparison between the load wear index of the compositions.

The foregoing test i) was performed using each sample grease composition which was admixed with 1% of the earth and sand originated from Kanto Loam (JIS 8 Type).

The grease compositions of Examples 1 and 2 and Comparative Examples 7 and 8 each exhibited only a small decrease in the load wear index.

The grease compositions of Comparative Examples 1 to 6 each showed a large decrease in the load wear index.

iii) Evaluation by Practical Test: In this test, the durability of the pin-bush portions of the boom cylinder foot was evaluated using a middle size hydrauric excavator.

The pin-bush portions at the lower part of the boom cylinders were coated with each sample grease and then the equipment was moved up and down at a constant velocity and in constant intervals while the boom's arm cylinders were extended to its full length (or straightened) to determine the number of the up and down movements required till the pin-bush portions caused the squeak (or generated squeaking sounds).

In this respect, the portion to be lubricated other than the pin-bush portions at the lower part of the boom cylinders were appropriately lubricated.

The grease compositions of Examples 1 and 2 each exhibited a large number of up and down movements required for causing the squeak. This accordingly indicates that they are excellent in the durability.

Test for Corrosion Preventive Properties

This was evaluated by the Grease-Bearing Corrosion-Preventive Properties Test Method (ASTM D 1743-73).

#1: rust-proof

#2: rust is formed; between one to three spots.

#3: rust is formed; not less than four spots.

The grease compositions of Examples 1 and 2 and Comparative Examples 1 to 6 and 8 were excellent in corrosion-preventive properties, while the composition of Comparative Example 7 was inferior in the corrosion-preventive properties.

Copper Strip Corrosion Test

This was evaluated according to JIS K2220 5. 5B. A copper strip treated with each sample grease composition at 100° C. for 24 hours was examined on whether any change in color into black and green was observed or not.

The grease compositions of Examples 1 and 2 and Comparative Examples 1 to 7 did not cause any change in color of the copper strip, but the composition of Comparative Example 8 caused color change of the copper strip into black.

What is claimed is:

1. A grease composition for construction equipment comprising a lubricating grease, a) 1 to 5% by weight of phosphate glass and b) 1 to 5% by weight of a sulfur-phosphorus type extreme-pressure additive based on the total weight of the grease composition.

2. The grease composition of claim 1 wherein it comprises 1 to 3% by weight of the component a) and 1 to 3% by weight of the component b) based on the total weight of the grease composition.

3. The grease composition of claim 1 wherein it further comprises c) 0.5 to 3% by weight of an aromatic sulfonic acid salt based on the total weight of the grease composition.

4. The grease composition of claim 3 wherein it comprises 0.5 to 2% by weight of the component c) based on the total weight of the grease composition.

5. The grease composition of claim 1 wherein it further comprises d) 0.1 to 3% by weight of a triazole compound based on the total weight of the grease composition.

6. The grease composition of claim 5 wherein it comprises 0.25 to 2% by weight of the component d) based on the total weight of the grease composition.

7. The grease composition of claim 1 wherein it further comprises c) 0.5 to 3% by weight of an aromatic sulfonic acid salt and d) 0.1 to 3% by weight of a triazole compound based on the total weight of the grease composition.

8. The grease composition of claim 6 wherein it comprises 0.5 to 3% by weight of the component c) and 0.5 to 3% by weight of the component d) based on the total weight of the grease composition.

9. The grease composition of claim 1 wherein the phosphate glass used as the component a) comprises 45 to 75 mole % of $P_3O_5$, 10 to 35 mole % of $M_2O$ (wherein M represents an alkali metal) and 0 to 45 mole % of $B_2O_3$.

10. The grease composition of claim 1 wherein the lubricating grease composition comprises a base oil and a thickener.

* * * * *